US007975330B2

(12) United States Patent
Receveur et al.

(10) Patent No.: US 7,975,330 B2
(45) Date of Patent: Jul. 12, 2011

(54) OCCUPANT TRANSFER TOPPER

(75) Inventors: Timothy Joseph Receveur, Guilford, IN (US); Christopher R O'Keefe, Batesville, IN (US); Frederick Herman, Harrison, OH (US)

(73) Assignee: Hill-Rom Services, Inc.

( * ) Notice: Subject to any disclaimer, the term of this patent is extended or adjusted under 35 U.S.C. 154(b) by 0 days.

(21) Appl. No.: 12/570,691

(22) Filed: Sep. 30, 2009

(65) Prior Publication Data

US 2011/0072579 A1 Mar. 31, 2011

(51) Int. Cl.
*A61G 1/01* (2006.01)

(52) U.S. Cl. ..... 5/81.1 HS; 5/691; 5/81.1 T; 5/926

(58) Field of Classification Search ..... 5/81.1 R, 5/81.1 HS, 81.1 T, 691, 726, 500, 926
See application file for complete search history.

(56) References Cited

U.S. PATENT DOCUMENTS

| | | | | |
|---|---|---|---|---|
| 3,769,642 | A | 11/1973 | Warman | |
| 3,829,914 | A | 8/1974 | Treat | |
| 4,051,565 | A | 10/1977 | Berge | |
| 4,744,115 | A * | 5/1988 | Marchione | 5/81.1 T |
| 4,868,938 | A | 9/1989 | Knouse | |
| 5,138,731 | A * | 8/1992 | Harcrow, Jr. | 5/625 |
| 5,329,655 | A | 7/1994 | Garner | |
| 5,465,441 | A | 11/1995 | Chun | |
| 5,615,425 | A | 4/1997 | Corente | |
| 5,742,958 | A | 4/1998 | Solazzo | |
| 5,860,174 | A * | 1/1999 | Failor | 5/81.1 HS |
| 5,920,929 | A | 7/1999 | Hensley | |
| 6,701,544 | B2 * | 3/2004 | Heimbrock | 5/81.1 R |
| 7,650,654 | B2 | 1/2010 | Lambarth et al. | |
| 2007/0000048 | A1 | 1/2007 | Davis | |
| 2007/0180625 | A1 | 8/2007 | Walke | |
| 2009/0094743 | A1 * | 4/2009 | Tanaka et al. | 5/81.1 T |

FOREIGN PATENT DOCUMENTS

| | | | |
|---|---|---|---|
| WO | 94/20002 | A1 | 9/1994 |
| WO | 2008/108782 | A2 | 9/2008 |

OTHER PUBLICATIONS

A Hill-Rom Solution V-Cue Dynamic Air Therapy Brochure, © Hill-Rom 1998, Hill-Rom Batesville, IN 47006 International (812) 934-8173 www.hill-rom.com.

U.S. Appl. No. 12/570,673, filed Sep. 30, 2009 First Named Inventor Timothy Joseph Receveur Assignee Hill-Rom Services Inc. 300 Delaware Ave. Suite 530 Wilmington, DE 19801.

* cited by examiner

*Primary Examiner* — Michael Trettel
(74) *Attorney, Agent, or Firm* — Kenneth C. Baran

(57) ABSTRACT

One embodiment of a topper for a bed includes a liner assembly 40 having a top liner 42, a bottom liner 44 and a slip liner 70 underneath the bottom liner. The slip liner is of relatively lower friction than the top liner. An apron 62, with openings 76 therein, extends from the perimeter of the liners. Another embodiment includes a liner assembly having a top liner, a bottom liner and a slip liner underneath the bottom liner. The slip liner is of relatively lower friction than the top liner. Bridge straps 98, or 98' having a working length of at least the width of a host mattress minus the arm length of a fifth percentile female extend from the liner assembly.

31 Claims, 13 Drawing Sheets

OCCUPANT TRANSFER TOPPER

TECHNICAL FIELD

The subject matter described herein relates to occupant transfer from one occupant support to another occupant support, and particularly to a topper for facilitating such transfer. One example application for the described occupant transfer topper is for transferring a patient from one bed to another.

BACKGROUND

In hospitals and other caregiving settings it is sometimes necessary to transfer a patient from one bed (the source bed) to another (the destination bed). One or more caregivers transfer the patient by lifting and/or sliding the patient from the source bed to the destination bed. The physical effort required of the caregivers increases with increasing patient size and weight.

Various devices are used to assist in patient transfers. These include reduced friction sheets or pads and powered surfaces that create an air cushion. These devices are not without merit, but also suffer from drawbacks. For example occupant transfer devices can be costly. In addition, occupant transfer devices are typically specialized devices dedicated to patient transfer rather than being intended for "full time" use on the bed. As a result, the device must be retrieved from a remote location and positioned under the patient before the transfer can take place. In addition, occupant transfer devices can be awkward to use, requiring the caregiver to bend at the waist in order to reach across the width of the destination bed and pull the transfer device, now bearing the patient's weight, onto the destination bed. The caregiver's posture along with the need to exert a substantial force increases the risk of caregiver injury.

Accordingly, it is desirable to provide a patient transfer device that addresses at least some of the shortcomings of existing devices.

SUMMARY

One embodiment of a topper for a bed includes a liner assembly having a top liner, a bottom liner and a slip liner underneath the bottom liner. The slip liner is of relatively lower friction than the top liner. An apron, with openings therein, extends from the perimeter of the liners. Another embodiment includes a liner assembly having a top liner, a bottom liner and a slip liner underneath the bottom liner. The slip liner is of relatively lower friction than the top liner. Bridge straps having a working length of at least the width of a host mattress minus the arm length of a fifth percentile female extend from the liner assembly.

BRIEF DESCRIPTION OF THE DRAWINGS

The foregoing and other features of the various embodiments of the occupant transfer device described herein will become more apparent from the following detailed description and the accompanying drawings in which.

DETAILED DESCRIPTION

Figure 1:
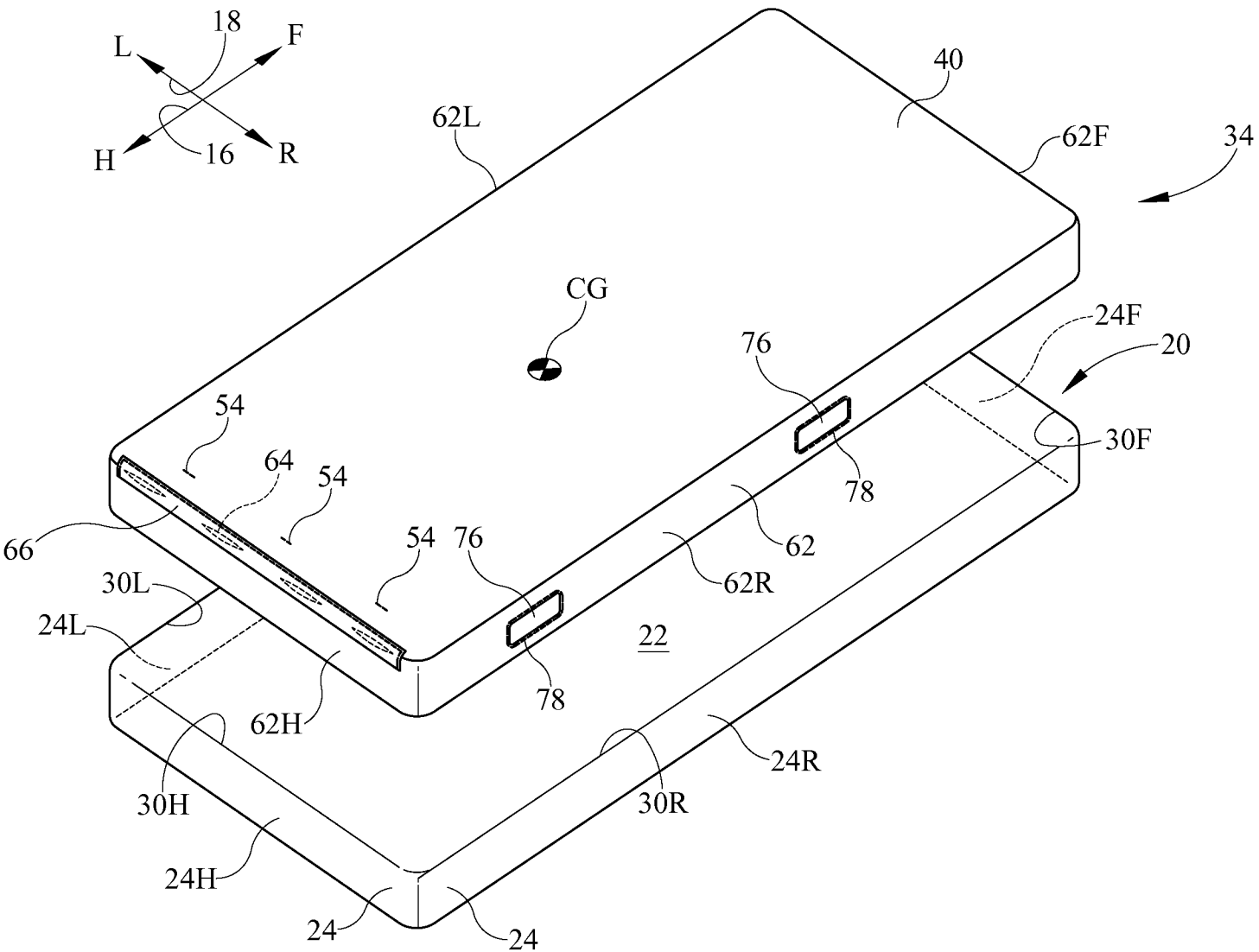
FIG. 1 is a perspective view of a mattress and the occupant transfer topper described herein with the topper vertically separated from the mattress and as seen by an observer looking from above.
Figure 2:
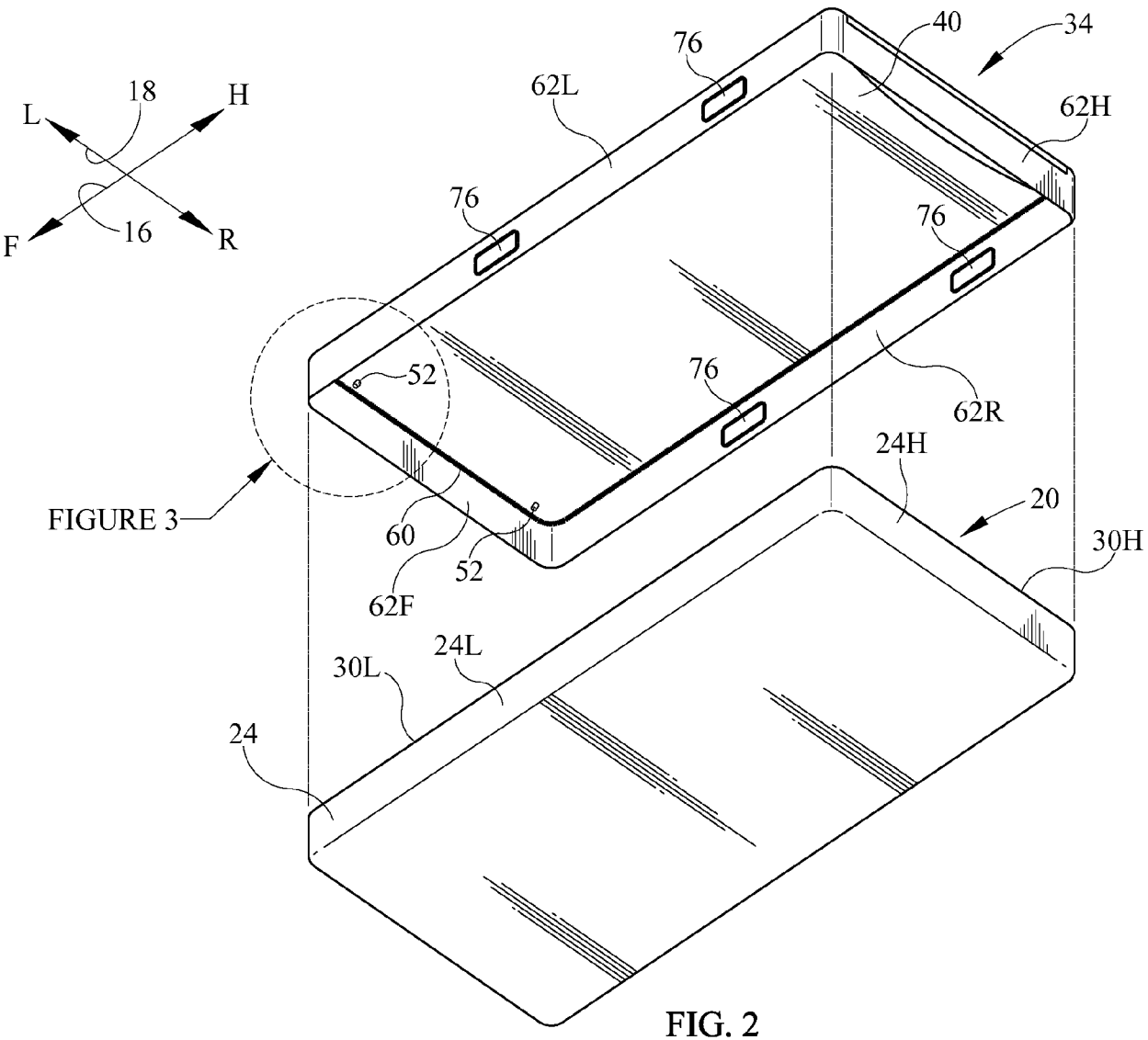
FIG. 2 is a view similar to that of FIG. 1 as seen by an observer looking from below.
Figure 3:
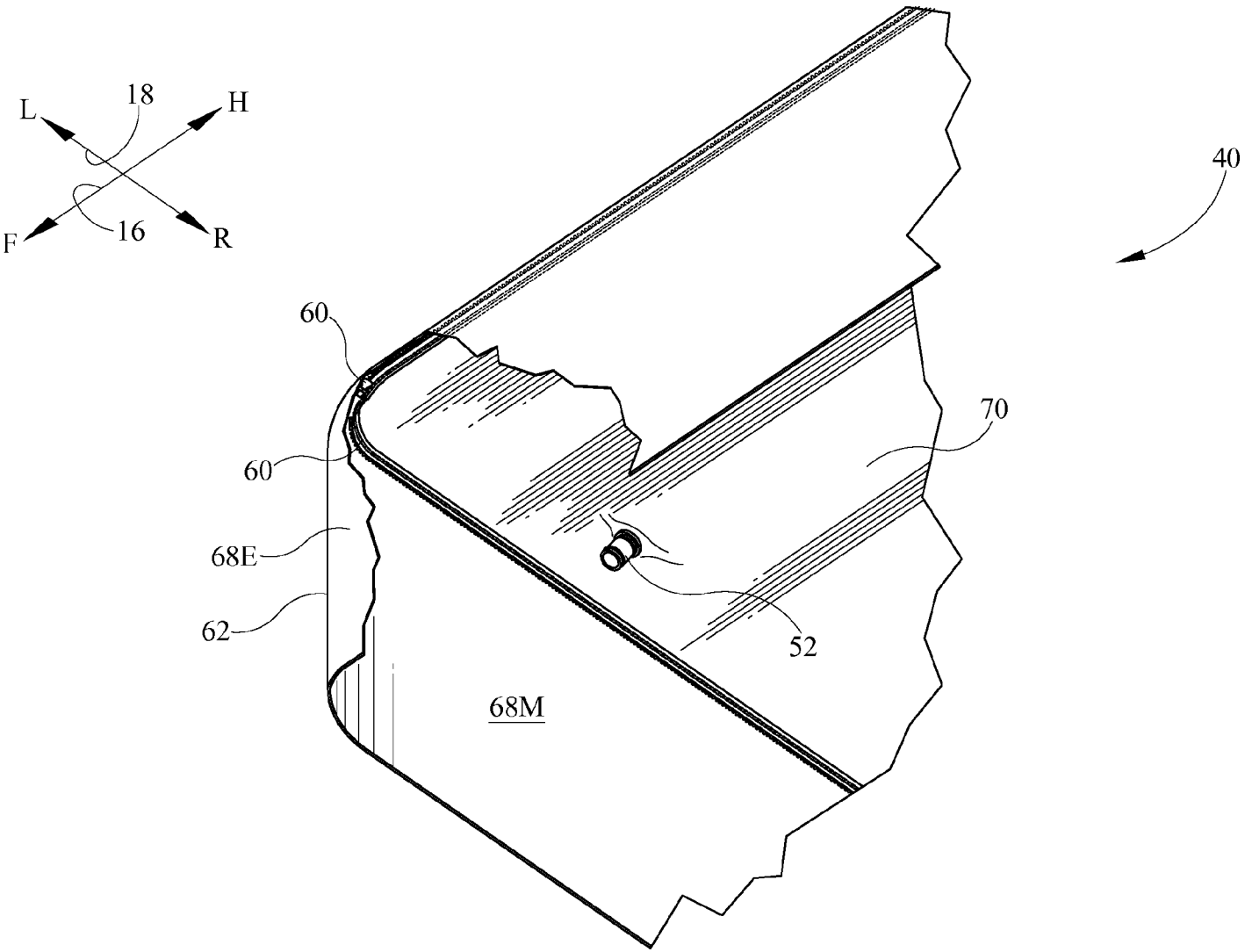
FIG. 3 is an enlarged, fragmentary perspective view of a corner of the topper of FIG. 3.
Figure 4:
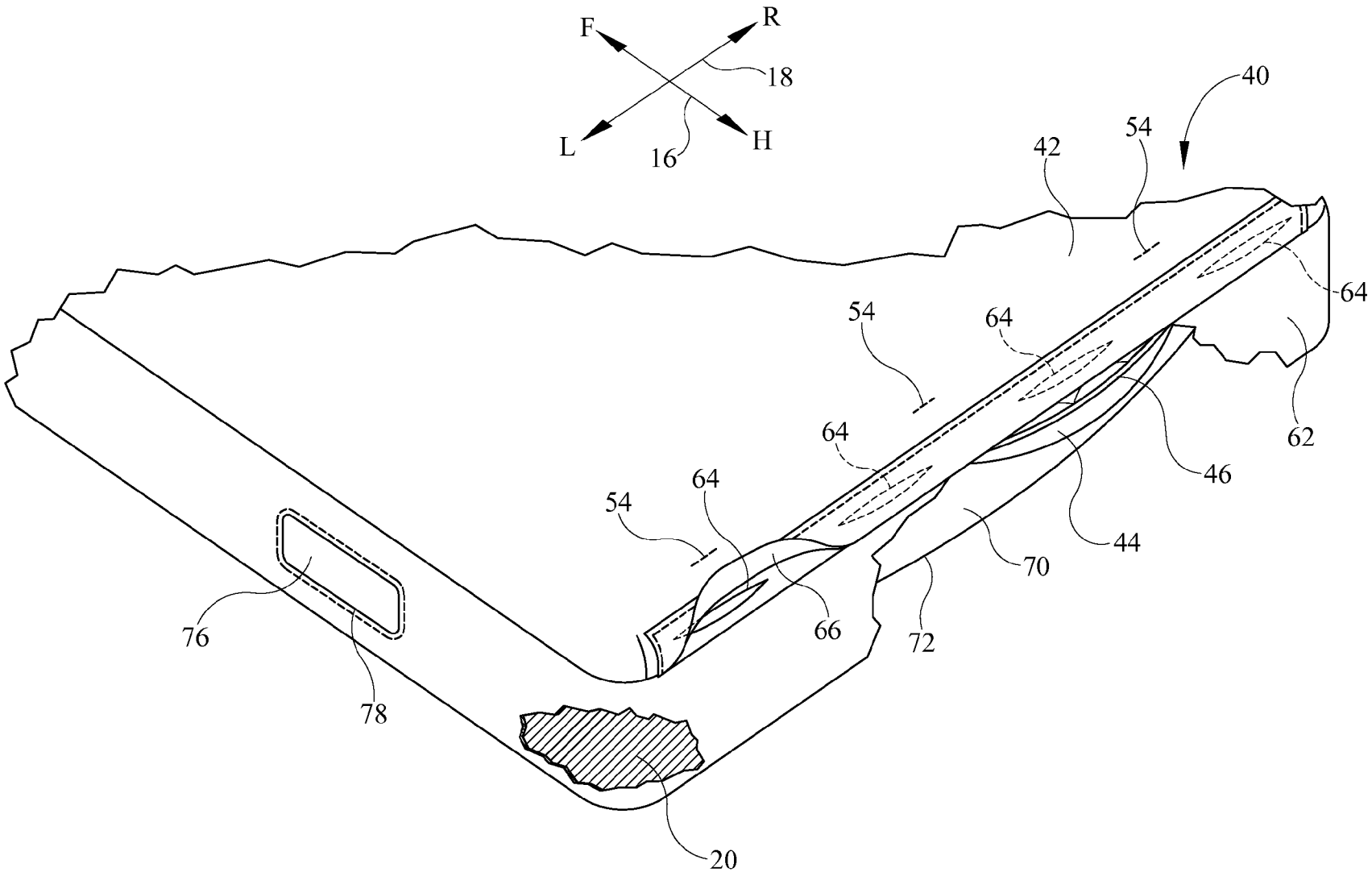
FIG. 4 is a fragmentary perspective view of the topper with portions thereof broken away.
Figure 5:
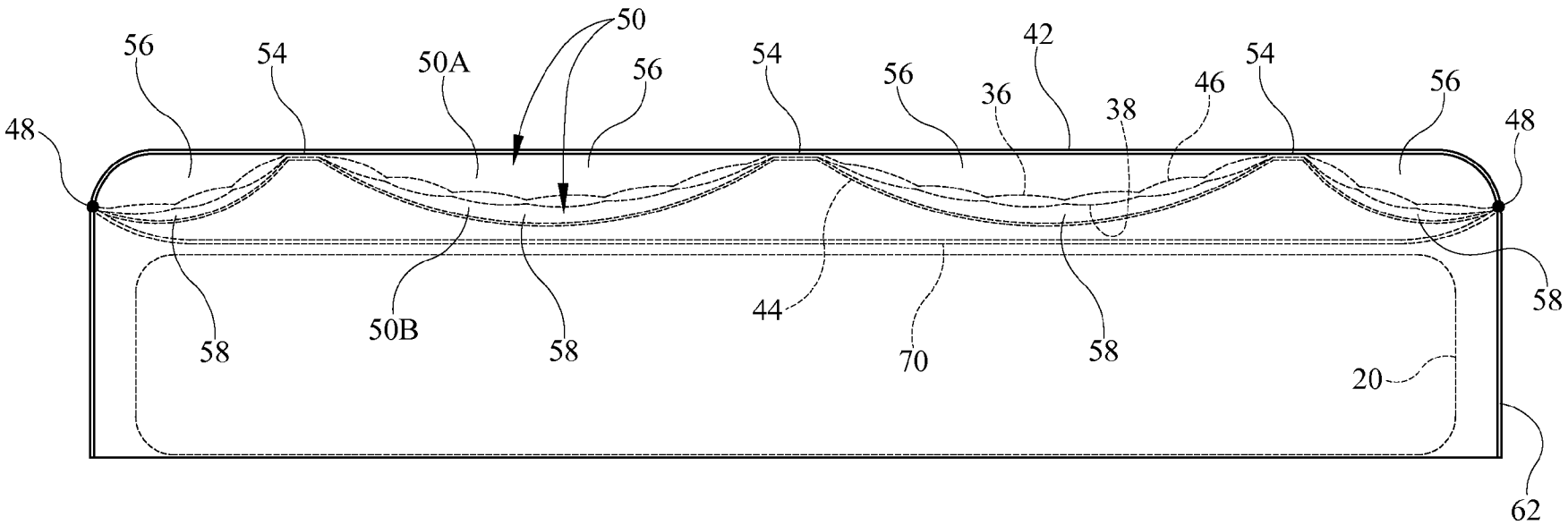
FIG. 5 is a head end elevation view of the topper showing top liner, separator, and bottom liner components thereof and a slip liner.

FIGS. 1-4 show a bed for a hospital or other caregiving setting. The illustrations include reference axes 16, 18 indicating longitudinal and lateral directions respectively. The bed includes a mattress 20 having a top side 22 and a four-sided flank 24 comprised of left, right, foot end and head end flank sections 24L, 24R, 24F, 24H corresponding to the head, feet, left and right sides of a supine occupant of the bed. The mattress top side 22 and the four flanks 24 define mattress edges 30L, 30R, 30F, 30H. The mattress normally rests on a frame, not illustrated. The mattress hosts an occupant transfer topper 34.

Referring additionally to FIGS. 5-8 topper 34 comprises a liner assembly 40 having a highly vapor permeable top liner 42, a bottom liner 44 and a separator 46 each with left, right, foot and head edges defining respective liner and separator perimeters. The separator has an upper side 36 and a lower side 38. The left, right and foot edges of the liners and separator are joined together at a seam 48 such that the liners define an internal space 50. The separator divides space 50 into upper and lower subspaces 50A, 50B. A pair of inlet fittings 52 (FIGS. 2 and 3) penetrates through bottom liner 44 near the foot edge thereof for introducing air into space 50. Spot stitching 54 is used to secure liners 42, 44 and separator 46 to each other at three laterally distributed locations about 2.5 inches (approximately 6.4 cm) from their respective head edges, thereby defining four upper outlets 56 and four lower outlets 58 for venting the internal space. Each spot-stitch extends laterally about 1 inch (about 2.5 cm). The seam 48 and the head edges of the liners define a perimeter of the liner assembly. When the topper is placed on the mattress, the top liner faces the occupant, the bottom liner faces the mattress, and the liner assembly perimeter coincides approximately with the mattress edge 30. A zipper member 60 extends around the perimeter of the liner assembly so that the liner assembly can be secured to the mattress. The topper also includes an apron 62 extending from the perimeter of the liner assembly and having left, right, head and foot panels 62L, 62R, 62H, 62F. The apron has a mattress side 68M facing the mattress and an exposed side 68E facing away from the mattress. The apron protects the zipper from contamination and damage, and guards against fluid ingress through the zipper. Four exhaust openings 64 (FIG. 4) penetrate through head apron panel 62H to exhaust air discharged through the outlets 56, 58. A flap 66 drapes over the exhaust openings to help keep contaminants out of the inter-liner space 50. One material suitable for use in the liner and apron is urethane coated nylon.

The separator 46 is of quilted construction. The upper side 36 of the separator is urethane coated nylon. The lower side 38 of the separator is polyester, cotton or a blend thereof. During use of the topper, inlets 52 admit pressurized air into the sub-spaces 50A, 50B. The air flows through the sub-spaces and discharges through upper and lower outlets 56, 58 and exhaust openings 64. The topper, therefore, forms at least part of a fluid flowpath beneath the bed occupant. The airflow through the topper helps keep the occupant cool and dry.

Figure 6:
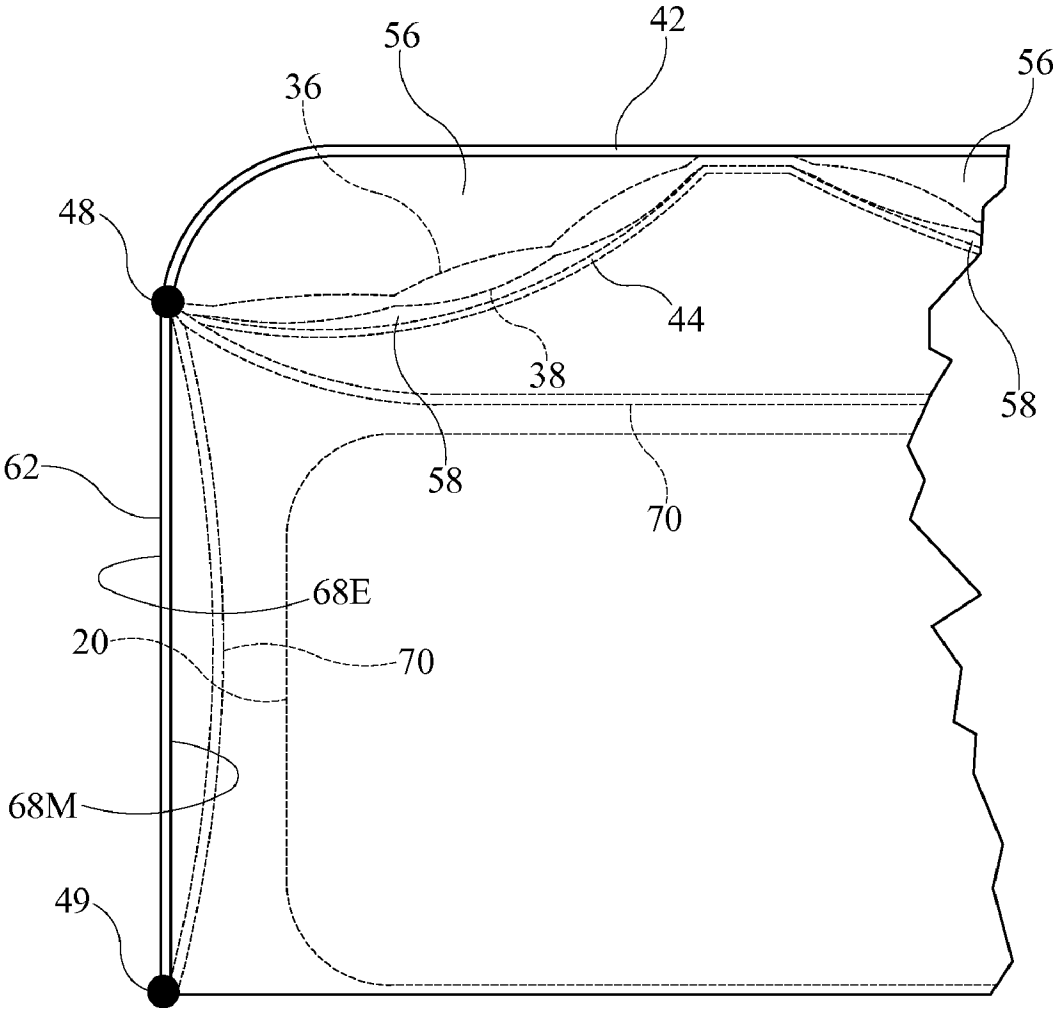
FIG. 6 is a partial fragmentary head end elevation view of the topper showing a slip liner extending along an apron portion of the topper.
Figure 7:
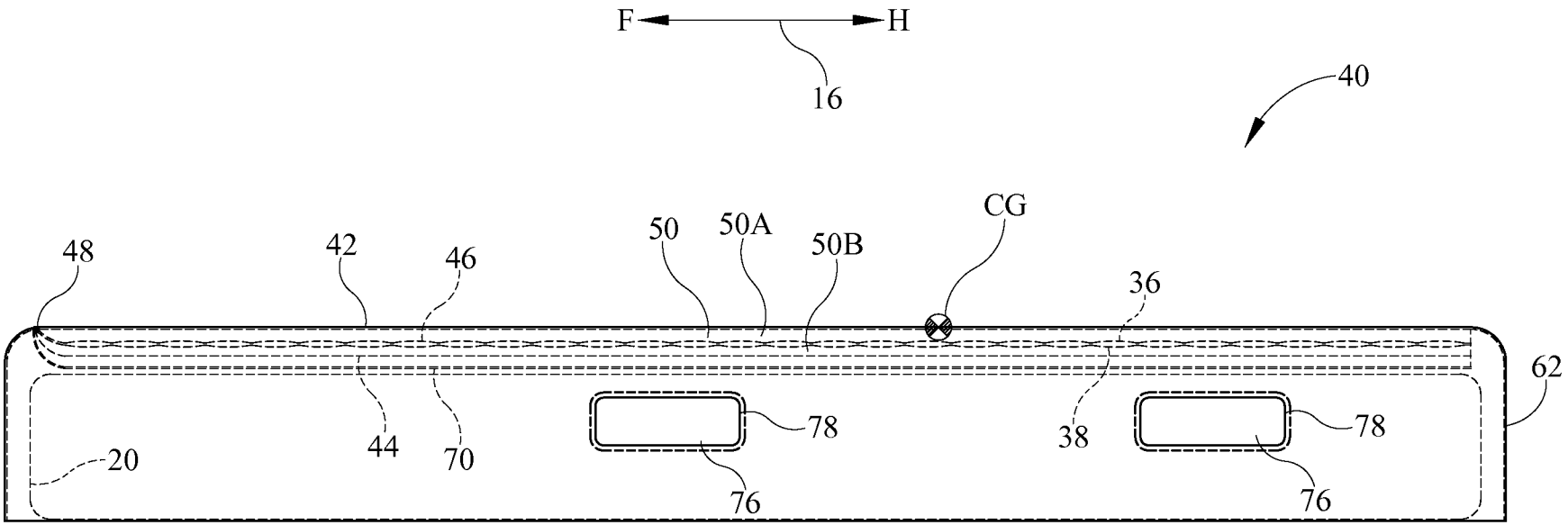
FIG. 7 is a side elevation view of the topper showing top liner, separator, and bottom liner components thereof, a slip liner, and a set of hand-hold openings in an apron portion of the topper.
Figure 8:
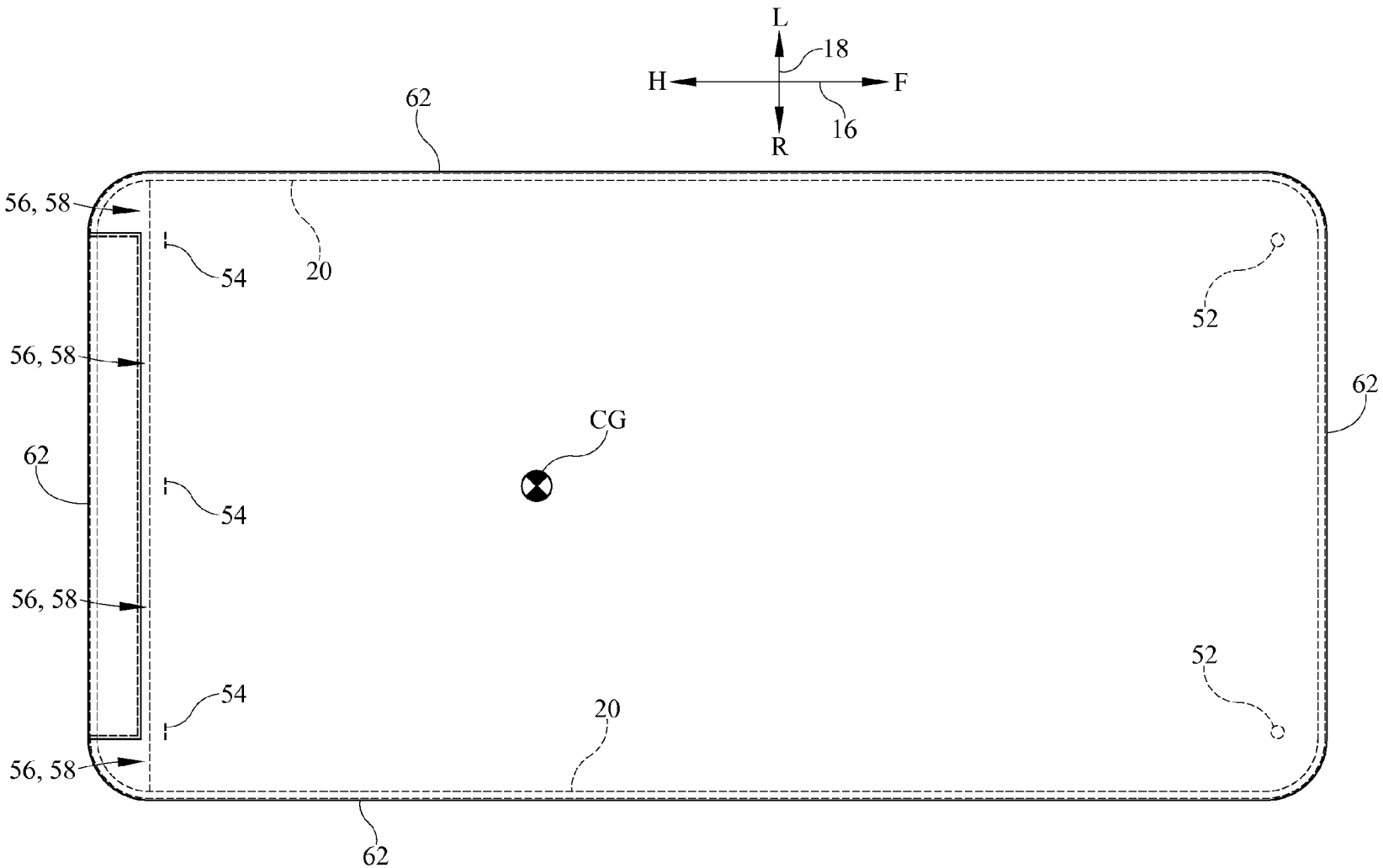
FIG. 8 is a plan view of the topper.

A slip liner 70 having a perimeter 72 is attached to the liner assembly underneath bottom liner 44 at or near seam 48. In the illustrated liner assembly the attachment is made by continuous stitching but can be made in any other satisfactory manner. Moreover, the slip liner may be a coating applied to bottom liner 44 rather than a sheet of material. The slip liner is made of ripstop nylon and exhibits relatively low friction in comparison to the top liner, i.e. it has a relatively slippery quality. The slip liner is laterally and longitudinally dimensioned to be substantially completely coextensive with the bottom liner. As seen in FIG. 6 the mattress side 68M of one or more of the apron panels 62 may also be lined with slip liner material of relatively low friction. The apron slip liner is joined to liners 42, 44 and separator 46 at seam 48 and to the bottom of the apron at seam 49.

Openings 76 penetrate through the left and right apron panels. Similar openings may also be present on the head and/or foot apron panels. The margin 78 of each opening is reinforced to resist ripping. The openings serve as hand-hold openings so that a caregiver can grasp the topper and slide it, and the occupant lying thereon, from a source bed to a destination bed. The side panel openings are approximately longitudinally equidistant from the estimated location CG of an occupant's center of gravity.

Figure 9:
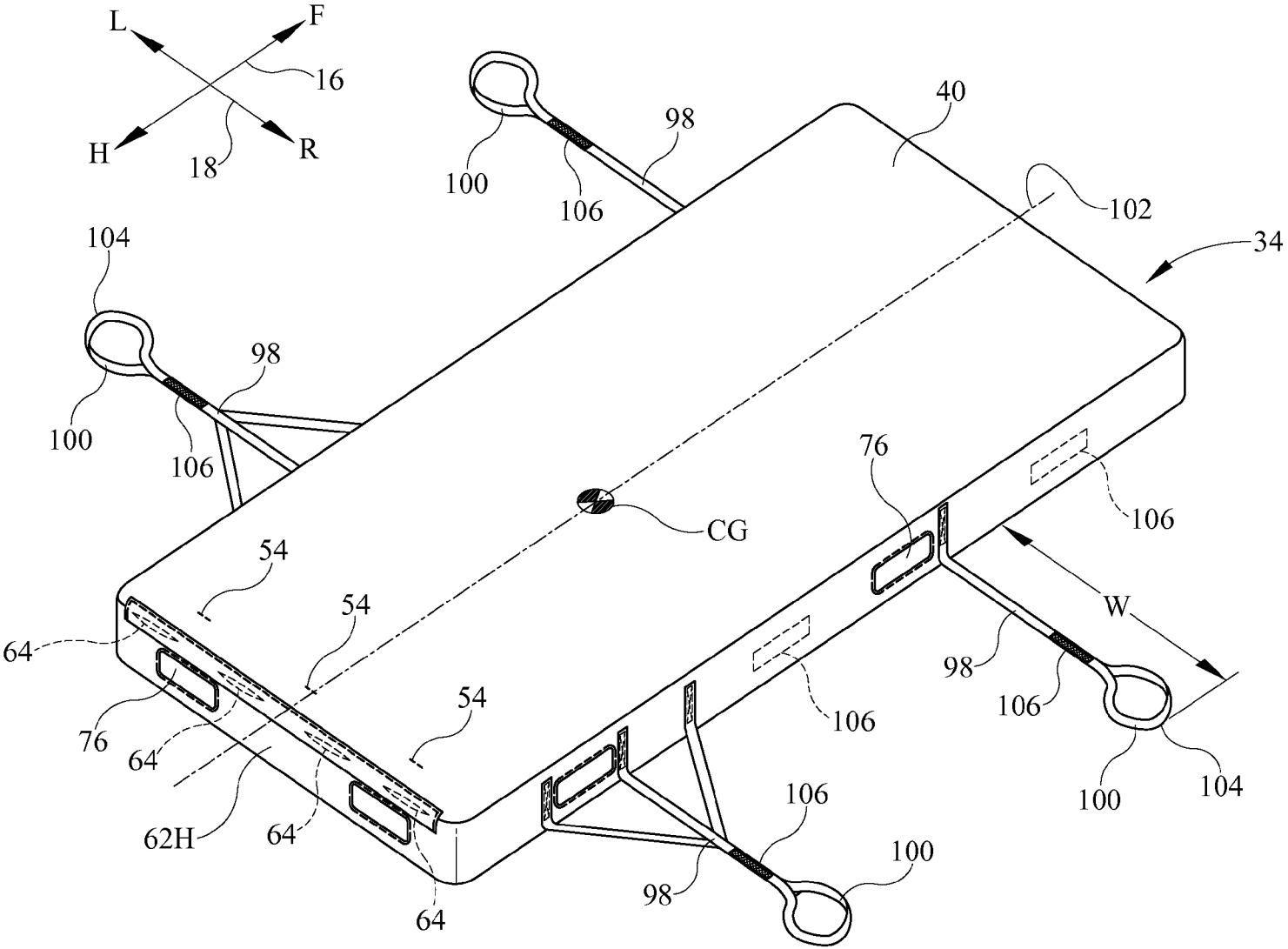
FIG. 9 is a perspective view of the topper showing two styles of inelastic bridge straps extending laterally therefrom.

Referring to FIG. 9, bridge straps 98 having a grip loop 100 are secured to and extend from the apron 62. The bridge straps may be provided instead of or in addition to the apron hand grip openings 76. If the hand grip openings are not provided, the apron itself may also be omitted from the construction and the straps may be secured to some other part of the topper. FIG. 9 shows two possible types of attachment—a linear attachment nearer the foot end of the topper and a "delta" attachment nearer the head end. Each strap has a working length W which is the distance from the left or right lateral edge 30L, 30R of the mattress (corresponding to the left and right perimeter edges of the liner assembly) to the end 104 of the grip loop when the strap is extended substantially perpendicular to the longitudinal centerline 102. The minimum working length equals about the width of a destination mattress reduced by the arm length of a fifth percentile female. Typical mattress widths in use in the United States are 36 inches (approximately 91.4 cm.) for non-bariatric mattresses and 40 inches (approximately 101.5 cm) for bariatric mattresses. The arm length of a fifth percentile female can be determined from anthropometric data, such as the data compiled in "The Measure of Man and Woman—Human Factors in Design" by Alvin R. Tilley, ISBN 0-471-09955-4.

Figure 10A:
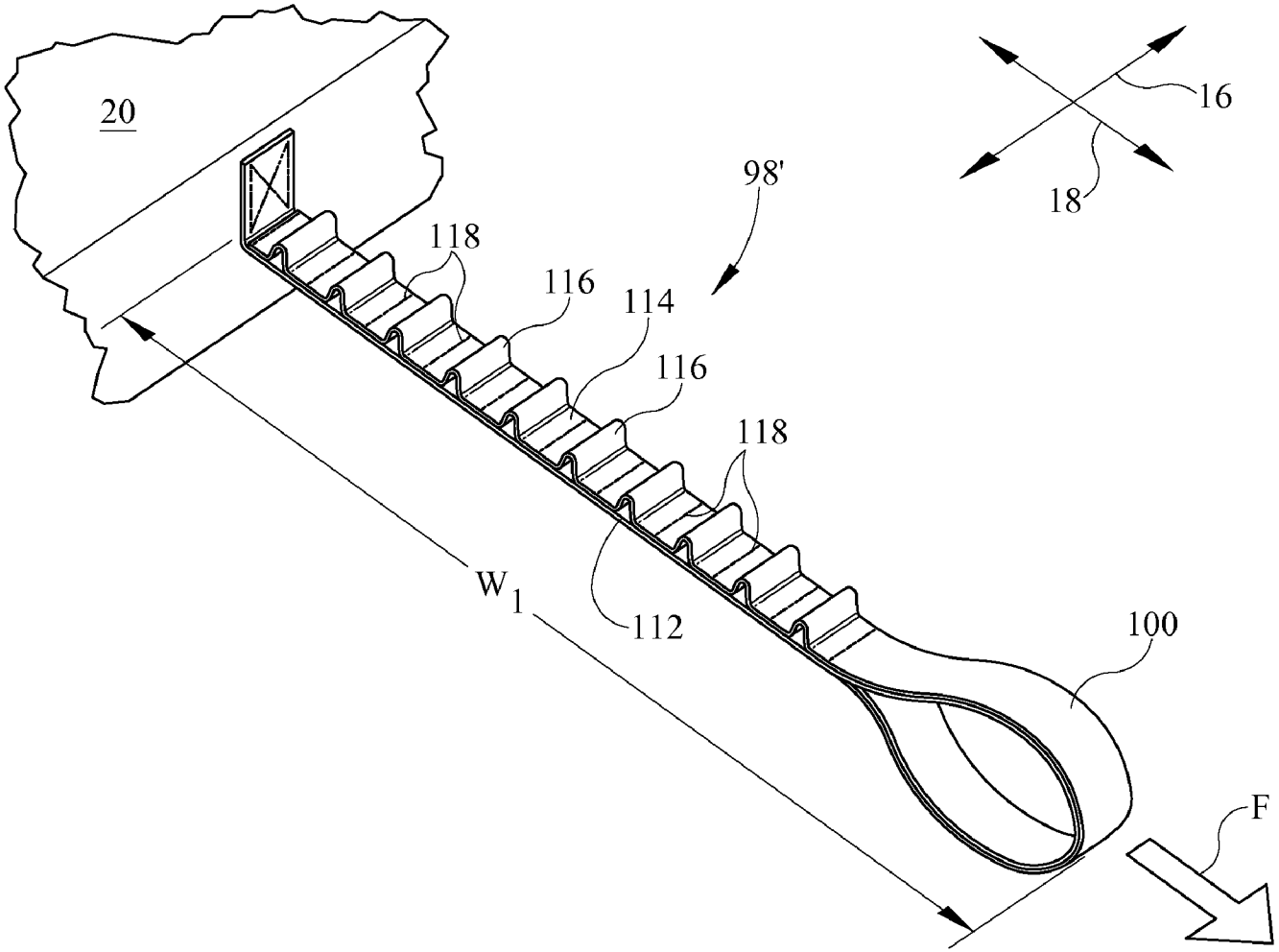
FIGS. 10A and 10B are perspective views showing a bridge strap featuring an elongation limited elastic construction, FIG. 10A showing the strap in a relaxed state and FIG. 10B showing the strap in a partially elongated state.
Figure 10B:
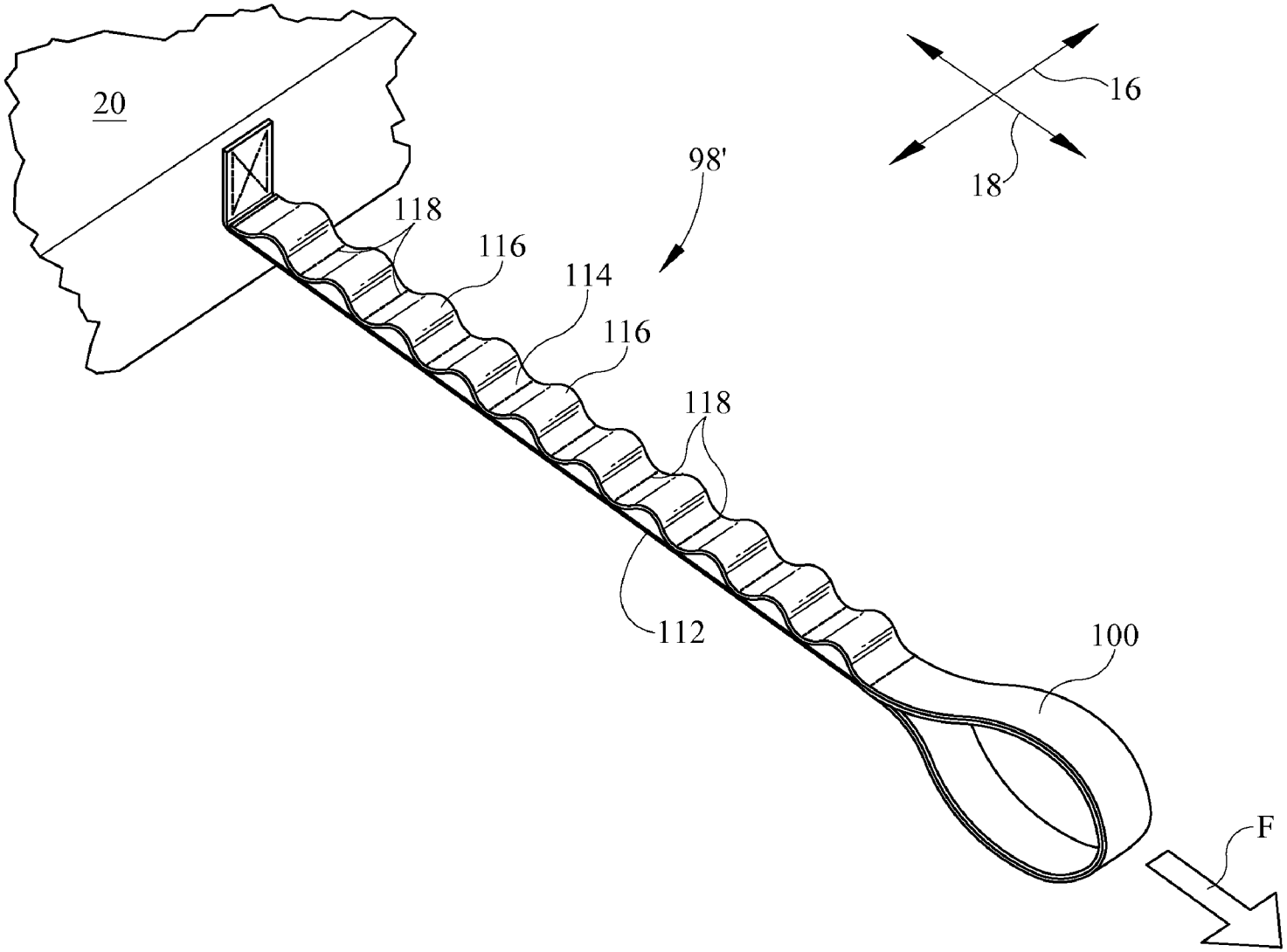

FIGS. 10A and 10B show an alternative construction for a bridge strap. Referring first to FIG. 10A bridge strap 98' comprises an elastic member 112, shown in its relaxed state, and an inelastic member 114. The inelastic member includes folds 116 and is attached to the elastic member at locations 118 intermediate the folds. When not in use, the bridge strap has a length $W_1$, smaller than its working length W. The smaller length allows the strap to be stored, when not in use, more conveniently than a strap of fixed length W. When a caregiver applies a force F to the strap, elastic member 112 stretches under the load while inelastic member 114 unfolds as seen in FIG. 10B. In the limit, the inelastic member extends unfolded along the stretched length of the elastic member thus providing a second load path in parallel with the load path through the elastic member and preventing any further elongation of the elastic member. The strap is thus at its full working length W.

It may be desirable to provide a way to store the straps between the mattress flanks 24 and the mattress side 68M of the apron when the straps are not in use. Mating fasteners, such as hook and loop fasteners 106, are provided on the straps and on the mattress lateral flanks or on the mattress side of the apron. When the straps are not in use, the fasteners may be used to store the straps adjacent the mattress where they are out of the way but accessible when needed.

Figure 11:
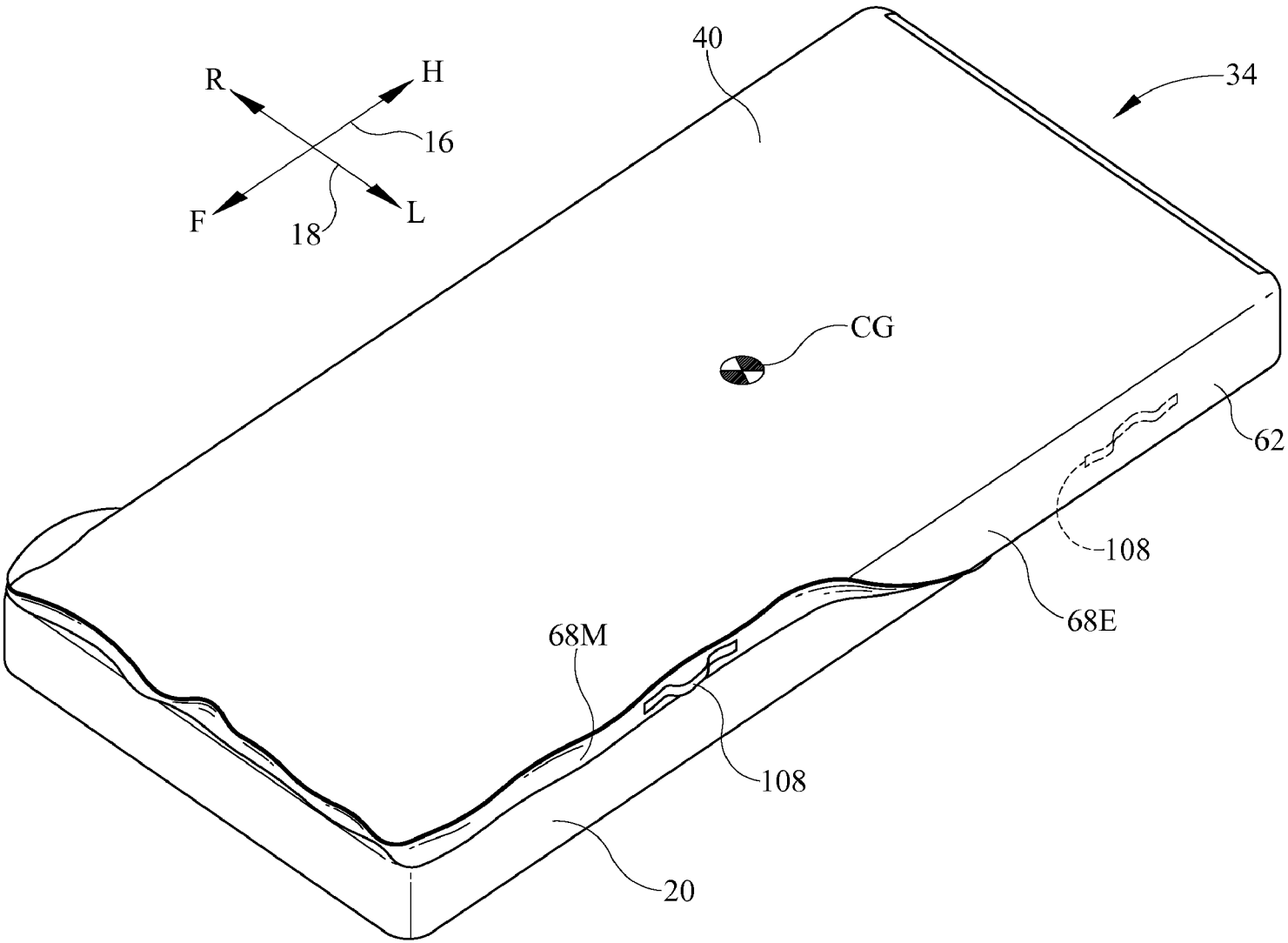
FIG. 11 is a perspective view of the topper installed on a mattress and with a portion of the topper turned up to expose a loop handle.

As seen in FIG. 11 it may also be desirable to include handles such as loop handles 108 shown secured to the mattress side of the apron. When the handles are not in use they remain stored between the mattress and the apron where they are easily accessible when needed but out of the way when not. To use the loop handles rather than the hand-hold openings, a caregiver turns up the apron panel to gain access to the handles.

Figure 12:
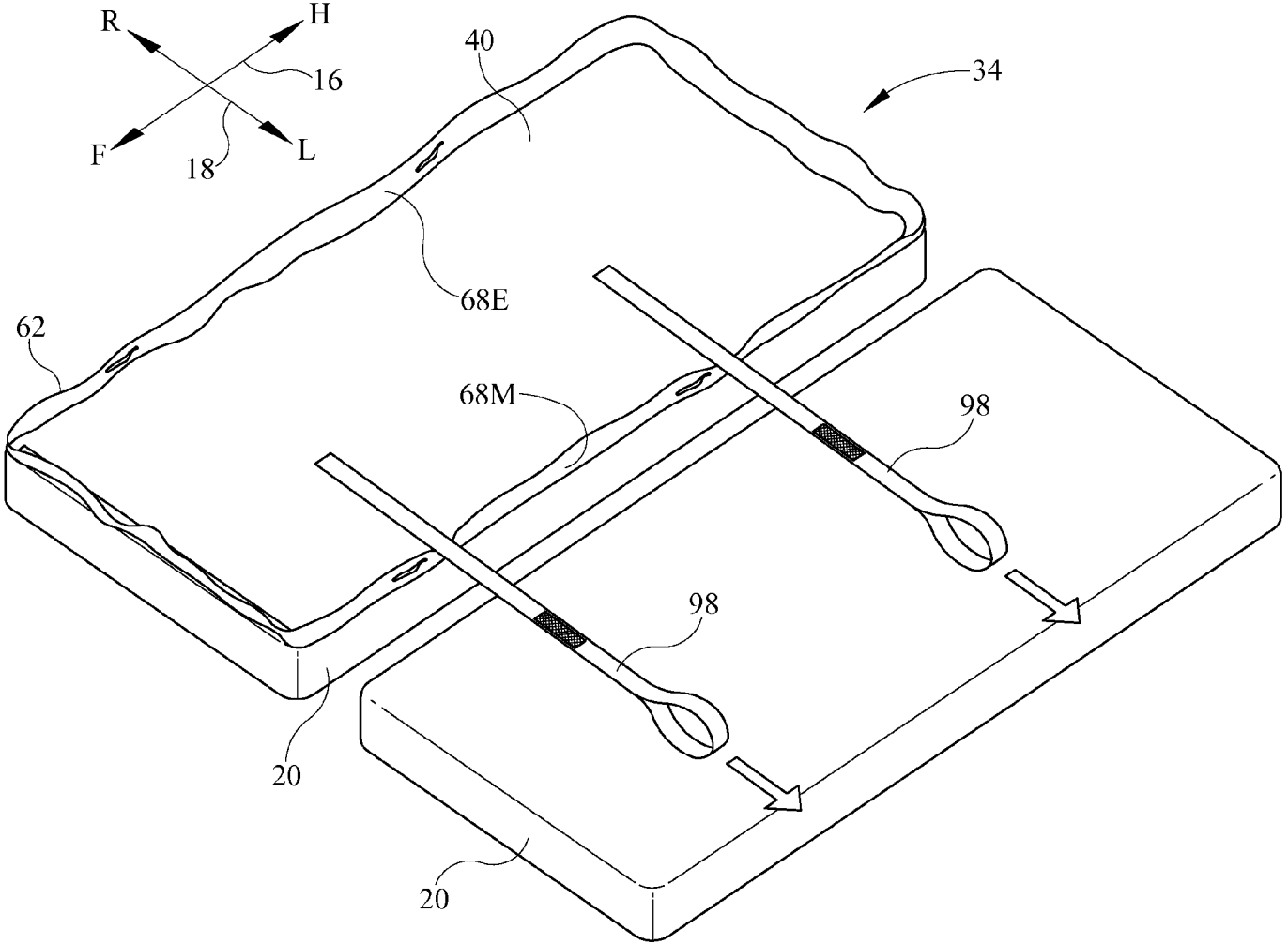
FIG. 12 is a perspective view showing transfer of the topper from a source mattress to a destination mattress.

The occupant transfer device doubles as a microclimate management topper. As a result the caregiver staff need not retrieve a dedicated transfer apparatus from a remote location and position the apparatus under the occupant as a prelude to occupant transfer. Instead, as seen in FIG. 12, it is sufficient for a staff member to position a destination bed laterally along side the source bed occupied by the occupant, deploy the bridge straps (if provided) by lying them across the top side of the destination mattress, position himself along the lateral edge of the destination mattress remote from the source mattress, and use either the apron hand grip openings 76, loop handles 108, bridge straps 98 or some combination thereof to pull the topper and the occupant onto the destination mattress. Because of the working length of the inelastic bridge straps 98, the free ends of the straps will be within easy reach of the caregiver. Accordingly, the caregiver can grasp the straps and pull the transfer sheet and the occupant onto the destination mattress without assuming an ergonomically risky posture. If the elastic bridge straps 98' are employed the caregiver will have to bend to initially grasp the straps, but will not have to exert any undue force on the straps until they elongate to their full working length W, at which point the caregiver's posture will be more ergonomically satisfactory. If desired the caregiver can grasp the handhold openings or the loop handles to finish the transfer. As already noted the bridge straps may be dispensed with in favor of the hand grip openings and/or loop handles, but a topper so constructed will lack the ergonomic benefits of a topper with bridge straps.

Although this disclosure refers to specific embodiments, it will be understood by those skilled in the art that various changes in form and detail may be made without departing from the subject matter set forth in the accompanying claims.

We claim:

1. A topper for a bed, comprising:

a liner assembly having a top liner and a bottom liner, a quilted separator intermediate the top and bottom liners;

an apron extending from a perimeter of the liners, the apron having openings therein; and a slip liner underneath the bottom liner, the slip liner being of relatively lower friction than the top liner.

2. The topper of claim 1 wherein the liner assembly defines at least part of a fluid flowpath having an inlet and an outlet.

3. The topper of claim 1 wherein a mattress side of the apron also includes a slip liner of relatively low friction.

4. The topper of claim 1 wherein the slip liner has a perimeter secured to the liner assembly at a perimeter of the liner assembly.

5. The topper of claim 1 wherein the slip liner is a coating.

6. The topper of claim 1 wherein the slip liner is substantially completely spatially coextensive with the bottom liner.

7. The topper of claim 1 including a bridge strap having a working length of at least the width of a host mattress minus the arm length of a fifth percentile female.

8. The topper of claim 1 including a loop handle secured to a mattress side of the apron.

9. A topper for a bed, comprising:

a liner assembly having a top liner and a bottom liner, the liner assembly defining at least part of a fluid flowpath having an inlet and an outlet;

a slip liner underneath the bottom liner, the slip liner being of relatively lower friction than the top liner;

bridge straps extending from the liner assembly and having a working length of at least the width of a host mattress minus the arm length of a fifth percentile female.

10. The topper of claim 9 including a separator intermediate the top and bottom liners.

11. The topper of claim 10 wherein the separator is quilted.

12. The topper of claim 9 including an apron extending from a perimeter of the liners.

13. The topper of claim 12 wherein a mattress side of the apron is lined with a slip liner of relatively low friction.

14. The topper of claim 9 wherein the slip liner has a perimeter secured to the liner assembly at a perimeter thereof.

15. The topper of claim 9 wherein the slip liner is a coating.

16. The topper of claim 9 wherein the slip liner is substantially completely spatially coextensive with the bottom liner.

17. The topper of claim 9 wherein the bridge strap is storable adjacent a host mattress.

18. The topper of claim 9 including an apron extending from a perimeter of the liners and having a hand-hold opening therein.

19. The topper of claim 12 including a loop handle secured to a mattress side of the apron.

20. A topper for a bed, comprising:

a liner assembly having a top liner and a bottom liner;

a separator intermediate the top and bottom liners;

a slip liner underneath the bottom liner, the slip liner being of relatively lower friction than the top liner;

bridge straps extending from the liner assembly and having a working length of at least the width of a host mattress minus the arm length of a fifth percentile female.

21. The topper of claim 20 wherein the separator is quilted.

22. A topper for a bed, comprising:

a liner assembly having a top liner and a bottom liner;

an apron extending from a perimeter of the liners;

a slip liner underneath the bottom liner, the slip liner being of relatively lower friction than the top liner;

bridge straps extending from the liner assembly and having a working length of at least the width of a host mattress minus the arm length of a fifth percentile female.

23. The topper of claim 22 wherein a mattress side of the apron is lined with a slip liner of relatively low friction.

24. A topper for a bed, comprising:

a liner assembly having a top liner and a bottom liner;

an apron extending from a perimeter of the liners and having a hand-hold opening therein;

a slip liner underneath the bottom liner, the slip liner being of relatively lower friction than the top liner;

bridge straps extending from the liner assembly and having a working length of at least the width of a host mattress minus the arm length of a fifth percentile female.

25. A topper for a bed, comprising:

a liner assembly having a top liner and a bottom liner;

an apron extending from a perimeter of the liners;

a loop handle secured to a mattress side of the apron;

a slip liner underneath the bottom liner, the slip liner being of relatively lower friction than the top liner;

bridge straps extending from the liner assembly and having a working length of at least the width of a host mattress minus the arm length of a fifth percentile female.

26. A topper for a bed, comprising:

a liner assembly having a top liner and a bottom liner, the liner assembly defining at least part of a fluid flowpath having an inlet and an outlet; and a slip liner underneath the bottom liner, the slip liner being of relatively lower friction than the top liner.

27. The topper of claim 26 including a separator intermediate the top and bottom liners.

28. The topper of claim 26 including an apron extending from a perimeter of the liners.

29. The topper of claim 28 wherein a mattress side of the apron is lined with a slip liner of relatively low friction.

30. The topper of claim 27 wherein the slip liner is a coating.

31. The topper of claim 26 wherein the slip liner is substantially completely spatially coextensive with the bottom liner.

* * * * *